US009776826B2

(12) United States Patent
Moore et al.

(10) Patent No.: US 9,776,826 B2
(45) Date of Patent: Oct. 3, 2017

(54) LOCKING RING AND PACKAGING FOR DISPENSING WOUND MATERIAL FROM A CONTAINER

(71) Applicant: REELEX Packaging Solutions, Inc., Patterson, NY (US)

(72) Inventors: Brian Moore, Newburgh, NY (US); Thomas Copp, Brookfield, CT (US)

(73) Assignee: REELEX Packaging Solutions, Inc., Patterson, NY (US)

( * ) Notice: Subject to any disclaimer, the term of this patent is extended or adjusted under 35 U.S.C. 154(b) by 311 days.

(21) Appl. No.: 14/513,662

(22) Filed: Oct. 14, 2014

(65) Prior Publication Data

US 2016/0101962 A1 Apr. 14, 2016

(51) Int. Cl.

| | |
|---|---|
| ***B65H 57/12*** | (2006.01) |
| ***B65H 57/18*** | (2006.01) |
| ***B65H 55/04*** | (2006.01) |
| *B65B 61/18* | (2006.01) |

(52) U.S. Cl.

CPC ..... *B65H 57/12* (2013.01); *B65H 55/046* (2013.01); *B65H 57/18* (2013.01); *B65B 61/186* (2013.01)

(58) Field of Classification Search

CPC ..... B65H 57/12; B65H 57/18; B65H 55/046; B65H 57/186; B65H 49/08; B65D 85/04

USPC ..... 242/615.3

See application file for complete search history.

(56) References Cited

U.S. PATENT DOCUMENTS

| | | | |
|---|---|---|---|
| 1,463,181 | A | 7/1923 | Vorderwinkler |
| 1,529,816 | A | 3/1925 | Stenglein |
| 2,388,557 | A | 11/1945 | Little et al. |
| 2,459,747 | A | 1/1949 | Kolbe |
| 2,634,918 | A | 4/1953 | Taylor et al. |
| 2,634,922 | A | 4/1953 | Taylor |
| 2,650,036 | A | 8/1953 | Berkepeis |
| 2,738,145 | A | 3/1956 | Taylor |
| 2,767,938 | A | 10/1956 | Taylor |
| 2,929,569 | A | 3/1960 | Detrick et al. |
| 2,943,732 | A | 7/1960 | Kovaleski et al. |
| 2,971,709 | A | 2/1961 | Ellis |

(Continued)

FOREIGN PATENT DOCUMENTS

| | | |
|---|---|---|
| DE | 532861 | 9/1931 |

OTHER PUBLICATIONS

U.S. Appl. No. 13/506,574; Timothy M. Copp et al, filed Apr. 30, 2012; Apparatus for Dividing Heat-Shrinkable Plastic Film into Different Temperature Regions.

*Primary Examiner* — Emmanuel M Marcelo
*Assistant Examiner* — Michael Gallion
(74) *Attorney, Agent, or Firm* — Gordon & Jacobson, P.C.

(57) ABSTRACT

A locking ring is described that permits removal of filamentary material housed in a walled container through a payout tube defining a payout tube axis and through which a first end of the filamentary material extends. The ring includes an annular flange around a ring axis and a body having a tubular wall extending from an inner edge of the annular flange to a distal edge of the ring. The tubular wall is coaxial with the ring axis, and has a plurality of teeth circumferentially spaced around the tubular wall and extend from the tubular wall radially outwardly and toward the annular flange. Each tooth resiliently deflects radially inwardly in response to interference between the tooth and an inner wall of the payout tube. The curved edges form a thread permitting the ring to advance axially into and secure with the payout tube.

19 Claims, 5 Drawing Sheets

(56) References Cited

U.S. PATENT DOCUMENTS

| | | | |
|---|---|---|---|
| 3,061,238 | A | 10/1962 | Taylor |
| 3,150,769 | A | 9/1964 | Cohn |
| 3,178,130 | A | 4/1965 | Taylor |
| 3,589,096 | A | 6/1971 | Podvin |
| 3,643,987 | A | 2/1972 | DuPont |
| 3,655,140 | A | 4/1972 | Gordon et al. |
| 3,666,200 | A | 5/1972 | Newman et al. |
| 3,677,490 | A | 7/1972 | Gordon et al. |
| 3,677,491 | A | 7/1972 | Gerwig |
| 3,747,861 | A | 7/1973 | Wagner et al. |
| 3,748,817 | A | 7/1973 | Newman |
| 3,812,640 | A | 5/1974 | Knott |
| 3,877,653 | A | 4/1975 | Foltyn et al. |
| 3,923,270 | A | 12/1975 | Newman et al. |
| 3,980,244 | A | 9/1976 | Pietroni |
| 3,982,712 | A | 9/1976 | Bassett |
| 3,985,315 | A | 10/1976 | Newman |
| 4,009,845 | A | 3/1977 | Santucci et al. |
| 4,019,636 | A | 4/1977 | Wise |
| 4,022,399 | A | 5/1977 | Zajac |
| 4,057,203 | A | 11/1977 | Newman et al. |
| 4,057,204 | A | 11/1977 | Zajac |
| 4,085,902 | A | 4/1978 | Wagner |
| 4,098,467 | A | 7/1978 | Engmann et al. |
| 4,160,533 | A | 7/1979 | Kotzur et al. |
| 4,274,607 | A | 6/1981 | Priest |
| 4,283,020 | A | 8/1981 | Bauer et al. |
| 4,285,157 | A | 8/1981 | Lambert |
| 4,313,579 | A | 2/1982 | Zuber et al. |
| D267,394 | S | 12/1982 | Liptak et al. |
| 4,367,853 | A | 1/1983 | Kotzur |
| 4,373,687 | A | 2/1983 | Zicko |
| 4,406,419 | A | 9/1983 | Kotzur |
| 4,477,033 | A | 10/1984 | Kotzur et al. |
| 4,523,723 | A | 6/1985 | Kotzur |
| D285,176 | S | 8/1986 | Kodousek et al. |
| 4,637,564 | A | 1/1987 | Hallenbeck et al. |
| 4,792,100 | A | 12/1988 | Pepe |
| 4,817,796 | A | 4/1989 | Camillo et al. |
| 4,884,764 | A | 12/1989 | Hill |
| 5,042,739 | A | 8/1991 | Zajac |
| 5,053,795 | A | 10/1991 | Wyman |
| 5,115,995 | A | 5/1992 | Hunt |
| 5,121,584 | A | 6/1992 | Suter |
| 5,150,789 | A | 9/1992 | Bass |
| 5,150,852 | A | 9/1992 | Hunt et al. |
| 5,203,139 | A | 4/1993 | Salsburg et al. |
| D341,777 | S | 11/1993 | Sheu |
| D348,392 | S | 7/1994 | Tannen |
| 5,368,245 | A | 11/1994 | Fore |
| 5,470,026 | A | 11/1995 | Kotzur |
| 5,499,775 | A | 3/1996 | Vander Groef |
| 5,520,347 | A | 5/1996 | Bass et al. |
| 5,529,186 | A | 6/1996 | Bass |
| 5,593,035 | A | 1/1997 | Taylor et al. |
| 5,624,528 | A | 4/1997 | Abrams et al. |
| 5,678,778 | A | 10/1997 | Kotzur et al. |
| 5,714,936 | A | 2/1998 | Regelsberger |
| D396,632 | S | 8/1998 | Lee |
| 5,803,394 | A | 9/1998 | Kotzur et al. |
| 5,810,272 | A | 9/1998 | Wallace et al. |
| D400,096 | S | 10/1998 | Lee |
| D406,753 | S | 3/1999 | Lee |
| 5,941,050 | A | 8/1999 | Georgetti et al. |
| 5,979,811 | A | 11/1999 | Bass et al. |
| 5,979,812 | A | 11/1999 | Kotzur et al. |
| 6,003,667 | A | 12/1999 | Barnett et al. |
| 6,086,012 | A | 7/2000 | Kotzur et al. |
| 6,098,378 | A | 8/2000 | Wyatt |
| 6,109,554 | A | 8/2000 | Kotzur et al. |
| 6,145,722 | A | 11/2000 | Behrens et al. |
| 6,276,623 | B1 | 8/2001 | Williams |
| 6,328,238 | B1 | 12/2001 | Chism |
| 6,341,741 | B1 | 1/2002 | Kotzur et al. |
| 6,491,163 | B1 | 12/2002 | Grcic et al. |
| 6,702,213 | B2 | 3/2004 | Kotzur et al. |
| 6,766,627 | B2 | 7/2004 | Kotzur et al. |
| 7,007,799 | B2 | 3/2006 | Cote |
| 7,100,346 | B2 | 9/2006 | Kotzur et al. |
| 7,156,334 | B1 | 1/2007 | Fore, Sr. et al. |
| D541,145 | S | 4/2007 | Copp |
| 7,249,726 | B2 | 7/2007 | Kotzur |
| 7,469,520 | B2 | 12/2008 | Lancaster, III et al. |
| 8,191,337 | B2 | 6/2012 | Moore |
| 8,794,438 | B2 | 8/2014 | Copp et al. |
| 8,944,358 | B2 | 2/2015 | Copp |
| 2002/0174626 | A1 | 11/2002 | Lancaster, III et al. |
| 2007/0272346 | A1 | 11/2007 | Shpik et al. |
| 2008/0277523 | A1 | 11/2008 | Delmore |

LOCKING RING AND PACKAGING FOR DISPENSING WOUND MATERIAL FROM A CONTAINER

BACKGROUND

1. Field

The present disclosure relates to packaging for a coil of wound material. More particularly, the present disclosure relates to a barbed locking ring for securing a tube to a container that holds a coil of wound material that is to be dispensed through the tube.

2. State of the Art

U.S. Pat. No. 2,634,922 to Taylor describes the winding of flexible wire, cable or filamentary material (hereinafter "wire", which is to be broadly understood in the specification and claims) around a mandrel in a figure-eight pattern such that a package of material is obtained having a plurality of layers surrounding a central core space. By rotating the mandrel and by controllably moving a traverse that guides the wire laterally relative to mandrel, the layers of the figure-eight pattern are provided with aligned holes (cumulatively a "pay-out hole") such that the inner end of the flexible material may be drawn out through the payout hole. When a package of wire is wound in this manner, the wire may be unwound through the payout hole without rotating the package, without imparting a rotation in the wire around its axis (i.e., twisting), and without kinking. This provides a major advantage to the users of the wire. Coils that are wound in this manner and dispense from the inside-out without twists, tangles, snags or overruns are known in the art as REELEX- (a trademark of Reelex Packaging Solutions, Inc.) type coils. REELEX-type coils are wound to form a generally short hollow cylinder with a radial opening formed at one location in the middle of the cylinder. A payout tube may be located in the radial opening and the end of the wire making up the coil may be fed through the payout tube for ease in dispensing the wire.

Over the past fifty-plus years, improvements have been made to the original invention described in U.S. Pat. No. 2,634,922. For example, U.S. Pat. No. 5,470,026 to Kotzur describes means for controlling the reciprocating movement of the traverse with respect to the rotation of the mandrel in order to wind the wire on the mandrel to form a radial payout hole having a substantially constant diameter. In addition, over the past fifty-plus years, an increasing number of different types of wires with different characteristics are being wound using the systems and methods described in U.S. Pat. No. 2,635,922 and the subsequent improvements. For example, the figure-eight type winding has been used for twisted-pair type cable (e.g., Category 5, Category 6 and the like), drop cable, fiber-optic cable, electrical building wire (THHN), etc. Despite the widespread applicability of the technology, challenges remain in applying the technology to different wires.

SUMMARY

In one embodiment, a locking ring is provided that permits dispensing of filamentary material housed in a walled container through a payout tube defining a payout tube axis and through which a first end of the filamentary material extends. The ring includes an annular flange around a ring axis and a body having a tubular wall extending from an inner edge of the annular flange to a distal edge of the ring. The tubular wall is coaxial with the ring axis, and has a plurality of teeth circumferentially spaced around the tubular wall that extend from the tubular wall radially outwardly and toward the annular flange. The teeth have curved edges that are curved about the ring axis and an axis perpendicular to the ring axis. The curved outer surface is curved about the ring axis. Each tooth resiliently deflects radially inwardly in response to interference between a curved outer surface of the tooth and an inner wall of the payout tube. Each tooth may have a barbed edge that digs into the inner wall of the payout tube when the tooth is engaged with the inner wall of the payout tube. The teeth may be equally spaced circumferentially.

The body may have a plurality of circumferentially spaced ribs, where each rib extends longitudinally along the outer side of the tubular wall of the body. Each rib may be circumferentially spaced between two of the teeth. The ribs may be equally spaced circumferentially.

Each rib may be defined by a peak, a first tapered portion extending from the peak towards the distal edge, and a second tapered portion extending from the peak towards the flange. The first tapered portion may be angled at a first angle with respect to the outer side of the tubular wall of the body and the second tapered portion is angled at a second angle with respect to the outer side of the tubular wall of the body. The first angle may be larger than the second angle. Also, the first tapered portion may be spaced axially from the distal edge of the body. The first tapered portion of each rib may be constructed to align the ring axis of the locking ring with the axis of the payout tube when the distal edge of the body is introduced into the payout tube and the payout tube contacts at least one first tapered portion.

In another embodiment, an assembly is provided that includes a wound coil of filamentary material having a first end, a payout tube extending from an inside of the wound coil to an outside of the wound coil along a payout tube axis with the first end of the filamentary material extending through the payout tube. Also, the assembly includes a box containing the wound coil and payout tube. The box has a side wall defining a first hole and a second hole. Further, the assembly includes a locking ring having an annular flange around a ring axis and having a body having a tubular wall extending from an inner edge of the annular flange to a distal edge of the locking ring. The tubular wall is coaxial with the ring axis and the body extends through the first hole of the box and is received in the payout tube.

The tubular wall has a plurality of teeth circumferentially spaced around the tubular wall, each tooth having an outer edge curved about the ring axis and about an axis perpendicular to the ring axis. The teeth are capable of being resiliently deflected radially inwardly by interference between an outer curved surface of each tooth and an inner wall of the payout tube. The outer curved surface is curved about the ring axis. An outer side of the wall is frustoconical and the outer side of the wall has a smaller diameter at the distal edge than at the inner edge of the annular flange. In one embodiment, each curved outer edge of each tooth threads with the payout tube in a first rotational direction to secure the side wall of the box between the annular flange and the payout tube.

In another embodiment a method for packaging a wound coil of filamentary material for dispensing is provided. The method includes disposing a payout tube in the wound coil of filamentary material and introducing a first end of the filamentary material in the payout tube where the payout tube extends along a payout tube axis. Also, the method includes inserting the wound coil of filamentary material with the payout tube into a box and pulling the first end of the filamentary material through a first hole defined in a side wall of the box. Further, the method includes inserting a ring around the first end of the filamentary material and into the hole of the box and into the payout tube. The ring has an annular flange around a ring axis and a body that has a tubular wall extending from an inner edge of the annular flange to a distal edge of the ring. The tubular wall is coaxial with the ring axis. The wall has a plurality of teeth circumferentially spaced around the wall and extend from the wall radially outwardly and toward the annular flange. The body is constructed for relative axial movement within the payout tube. Each tooth is constructed to resiliently deflect radially inwardly in response to interference between an outer curved surface of the tooth and an inner wall of the payout tube. An outer side of the tubular wall is frustoconical, and the outer side of the tubular wall has a smaller diameter at the distal edge than at the inner edge of the annular flange.

In one aspect the curved edges of the teeth form a thread that permits the locking ring to advance axially into and secure with the payout tube when the teeth are engaged with the inner wall of the payout tube and are rotated in a first direction with respect to the payout tube.

DETAILED DESCRIPTION

Figure 1:
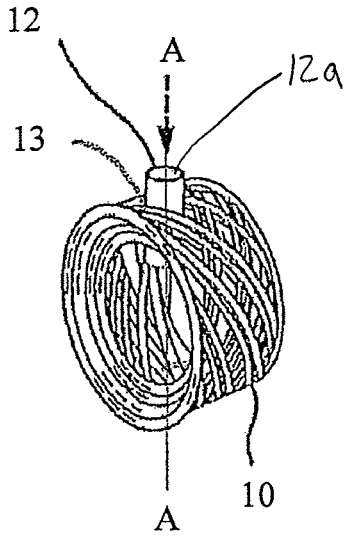
FIG. 1 illustrates a coil of filamentary material wound in a figure-eight configuration with a payout hole in the coil and a payout tube extending into the payout hole.

FIG. 1 illustrates a coil 10 of filamentary material wound in a figure-eight configuration with a payout hole 13 in the coil 10. The payout hole 13 extends from the inside of the coil 10 to the outside of the coil 10. A cardboard or plastic payout tube 12 (e.g., of approximately ⅛ inch thickness) having a tube axis A-A extends into the payout hole 13. An end of the coil 10 is inserted through the payout tube 12 so that the filamentary material is withdrawn through the payout tube 12 from the inside of the coil 10 to reduce or eliminate tangles in the withdrawn coil 10 of filamentary material.

Figure 2:
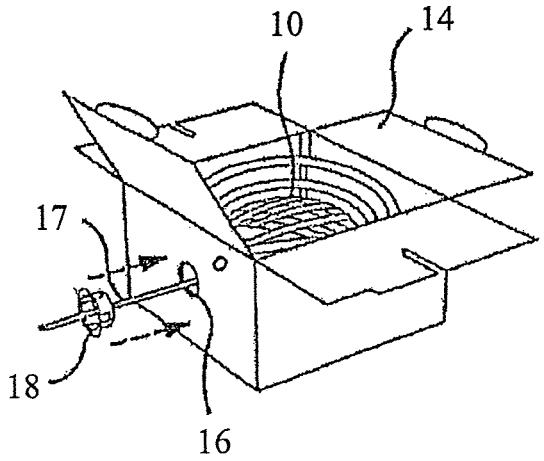
FIG. 2 illustrates a container containing the coil of FIG. 1 along with a locking ring.

FIG. 2 illustrates a container 14 containing the coil 10 of filamentary material and paper payout tube 12 as shown in FIG. 1, with an inside end 17 of the coil 10 threaded through the paper payout tube 12, a hole 16 in the container 14, and a locking ring 18. The hole 16 has a diameter smaller than the outer diameter of the payout tube 12 so that the tube 12 cannot pass through the hole 16. The locking ring 18 is constructed to be pushed in the hole in the container 14 and threaded firmly into the payout tube 12, thereby securely locking the payout tube 12 and locking ring 18 to the container 14.

Figure 3:
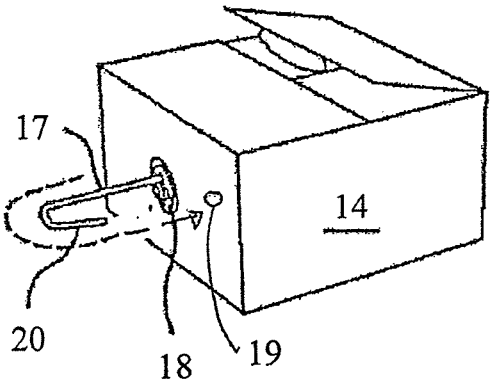
FIG. 3 illustrates the creation of a loop of the wound material outside of the container.

FIG. 3 illustrates the creation of a loop 20 from the inside end of the coiled material 10. In one aspect the inside end 17 of the coiled material 10 may be looped and inserted back into a hole 19 formed in the container 14. The loop 20 makes the coiled material 10 easily available to the end user.

Figure 4:
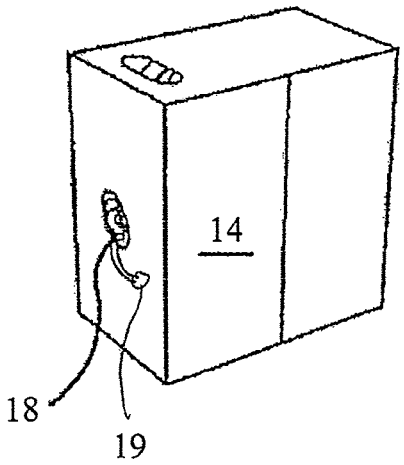
FIG. 4 illustrates a finished container or package with the loop of FIG. 3 shown inserted into the container.

FIG. 4 illustrates a finished container or package 14 with the looped end of the coiled material being conveniently inserted into the hole 19 in the container 14, yet is readily available to the end user. Also, stowing the inside end 17 of the material 10 in the hole 19 does not occupy much space on the outside of the container such that a plurality of containers can be stacked with minimum gaps between them for transport and shelf storage.

Figure 5:
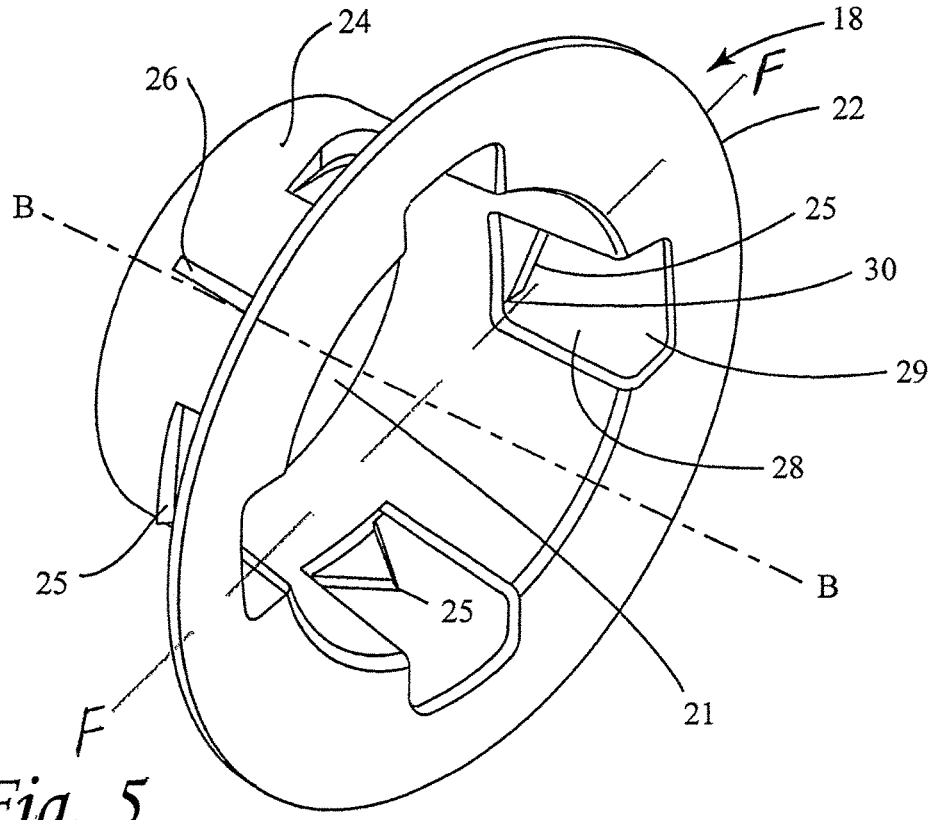
FIG. 5 is an isometric view of the locking ring of FIG. 1.

As shown in FIG. 5, locking ring 18 includes a circular flange 22 formed around one end of a frustoconical body 24 which, in its interior, defines an opening 21 through which an end of the filamentary material (not shown) passes, as shown in FIGS. 3 and 4, for example. The flange 22 and body 24 are coaxial with a ring axis B-B. The body 24 includes flexible teeth 25 (one tooth 25 out of four teeth is obscured in FIG. 5) formed around the circumference of the body 24. The locking ring 18 is attached to the payout tube 12 via hole 16 in the container 14 (FIG. 2) so that the container 14 is captured between the flange 22 of the ring 18 and the end face of the tube 12. The body 24 also has a plurality of ribs 26 that extend longitudinally along an outer side of the body 24. In the embodiment shown in FIGS. 5 and 7, each rib 26 is positioned between a pair of teeth 25. Specifically, in the embodiment shown in FIGS. 5 and 7, the teeth 25 are equally spaced circumferentially around the body 24 and the ribs 26 are equally spaced circumferentially around the body 24. In one embodiment, the teeth 25 are circumferentially spaced ninety degrees apart from each other and each rib 26 is circumferentially spaced 45 degrees between adjacent teeth 25.

Figure 6:
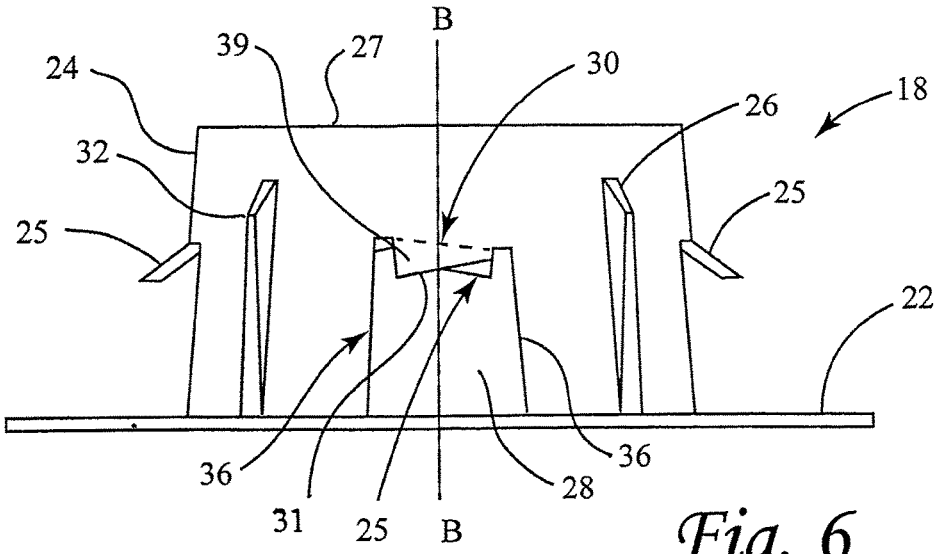
FIG. 6 is a side elevation view of the locking ring shown in FIG. 5.

Also, as shown in FIGS. 5 and 6, the body 24 has a plurality of trapezoidal openings 28. Each opening 28 extends longitudinally from a base 30 of each tooth 25 to an aligned annular notch 29 (FIG. 5) formed in the flange 22. Each tooth 25 is angled with respect to the body 24 and extends from the base 30 generally in a direction radially outwardly and longitudinally towards the flange 22. Each tooth 25 has an outer surface 39 that is curved about axis B-B. In one embodiment, the curvature of surface 39 is the same as that of the inner surface of payout tube 12. Also, ribs 26 extend longitudinally from the flange 22 toward a distal end 27 (FIG. 6) (i.e., distal with respect to the flange 22) of the body 24. In one embodiment, each rib 26 has a peak 32 closer to the distal end 27 than to the flange 22 and tapers down in height in both directions from the peak, with the outer face of the rib between the flange 22 and the peak 32 being generally perpendicular to the flange 22.

As seen in FIG. 6, the opening 28 is also defined by edges 36 that extend generally longitudinally. In the embodiment shown in FIGS. 1 to 11 the edges are slightly angled at about 87 degrees with respect to a plane passing through the flange 22, defining a generally trapezoidal shape. In addition, in the embodiment shown in FIGS. 1 to 11 the outer wall of the body 24 is slightly angled (at about 83 degrees) with respect to the plane passing through the flange 22. The angling of the body 24 facilitates aligning the distal end 27 of the body into the payout tube 12 during assembly and for tightening and loosening of the ring 18 with respect to the tube, as will be described in greater detail hereinbelow.

Figure 7:
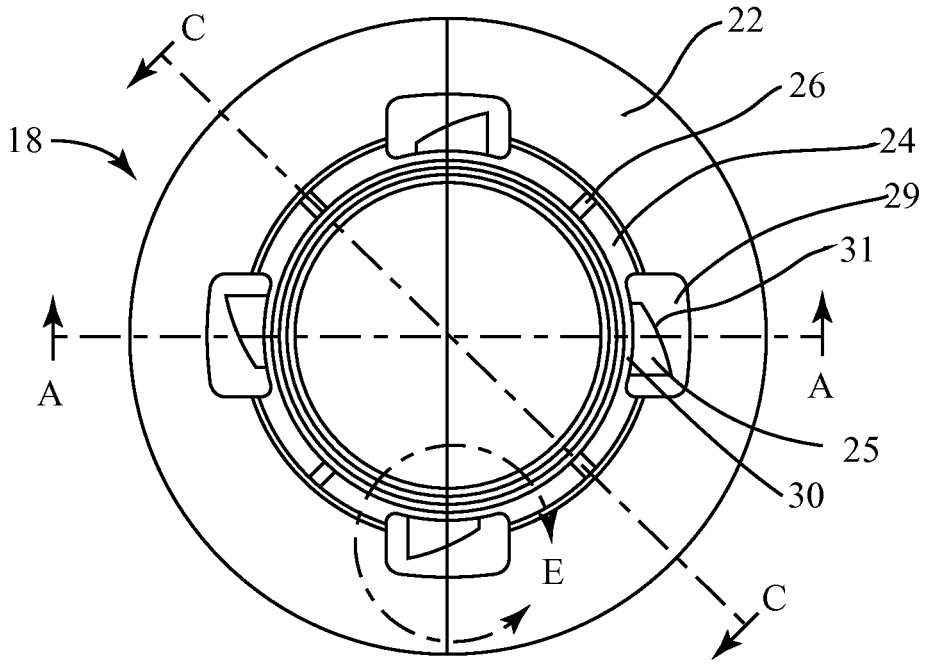
FIG. 7 is a plan view of the locking ring of FIG. 5, viewed from a bottom end thereof.
Figure 8:
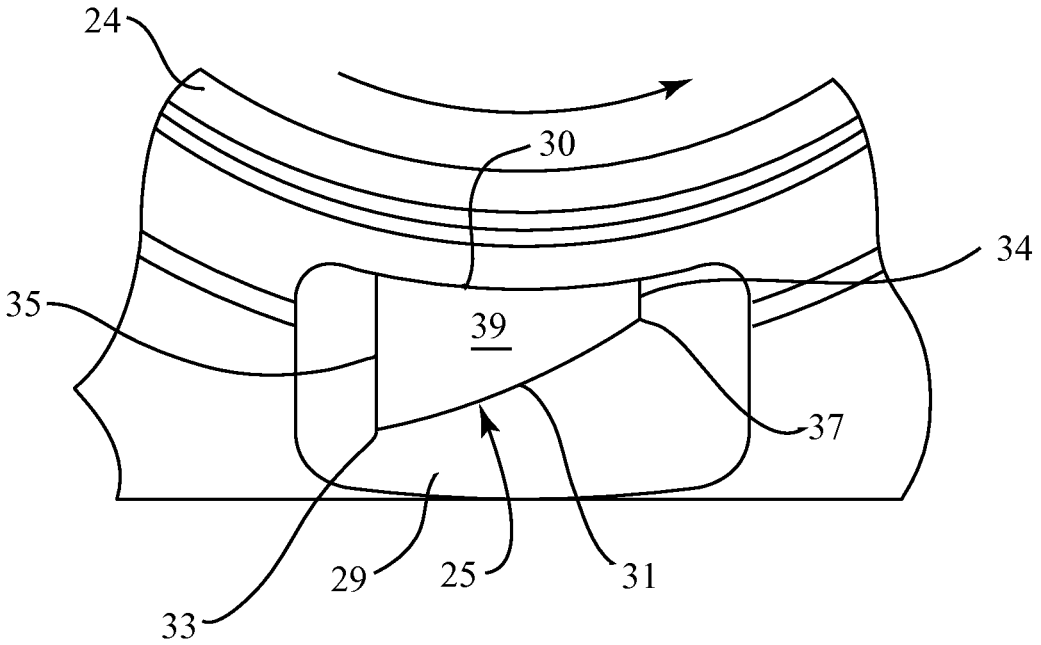
FIG. 8 is a detailed view of a portion of the locking ring labeled E in FIG. 7.

FIG. 7 shows a view of the locking ring 18 from flange 22 with each tooth 25 seen through a respective notch 29 formed in flange 22. FIG. 8 shows an exploded view of section E in FIG. 7 that shows one of the teeth 25 and surrounding structures of the locking ring 18. Each tooth 25 extends from its base 30 to a curved edge 31 that extends from a leading corner 37 to trailing corner or barb 33. Each tooth 25 has a first longitudinal edge 34 and a second longitudinal edge 35 spaced circumferentially by the curved edge 31 helping define the curved tooth surface 39. As shown in FIG. 8, the second edge 35 is relatively longer than the first edge 34 so that the curved edge 31 is generally diagonal (askew) with respect to both the first and second edges 34 and 35. In one embodiment, the circumferential width of the base 30 of the tooth 25 is about 0.35 inch and the difference in length between the first and second longitudinal edges 34 and 35 is about 0.135 inch. FIGS. 7 and 8 illustrate that the curved edge 31 is curved about axis B-B. Also, FIG. 6 illustrates that the curved edge 31 is also curved about an axis F-F (shown most clearly in FIG. 5) that is perpendicular to axis B-B.

Each tooth 25 is flexible and resilient and is constructed to deflect radially inwardly about its base 30 from an undeflected position, shown generally in FIGS. 5 to 11, to a deflected position (not shown). Each tooth 25 is constructed to deflect when pushed radially inwardly due to interference with an inner surface of the payout tube 12, which has an inner diameter that is smaller than the distance between barbs 33 on diametrically opposed teeth 25. The curved edge 31 of each tooth 25 provides a helical or screw-like thread that permits the locking ring 18 to be rotated or "threaded" into payout tube 12 in the direction of the arrow shown in FIG. 8, i.e., leading corner 37-first. Also, the corner 33 between the second longitudinal edge 35 and the curved edge 31 forms a barb which, given the resilient force exerted by the tooth 25 against the inner side of the tube 12, can dig against the inner surface of the payout tube 12 to resist rotation of the locking ring in a direction opposite the direction of the arrow shown in FIG. 8 once the locking ring 18 and the payout tube 12 are at least partly joined.

Figure 9:
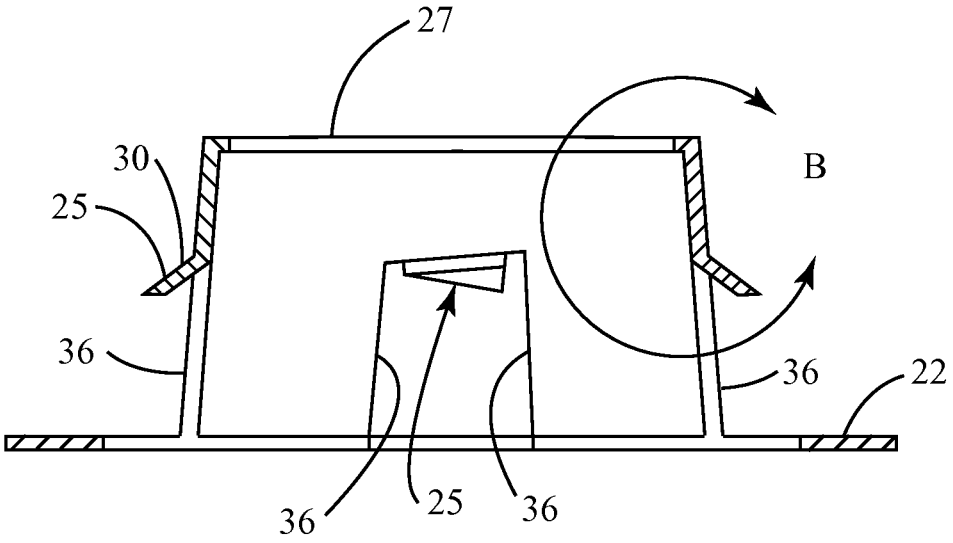
FIG. 9 is a view of the locking ring along section A-A in FIG. 7.
Figure 10:
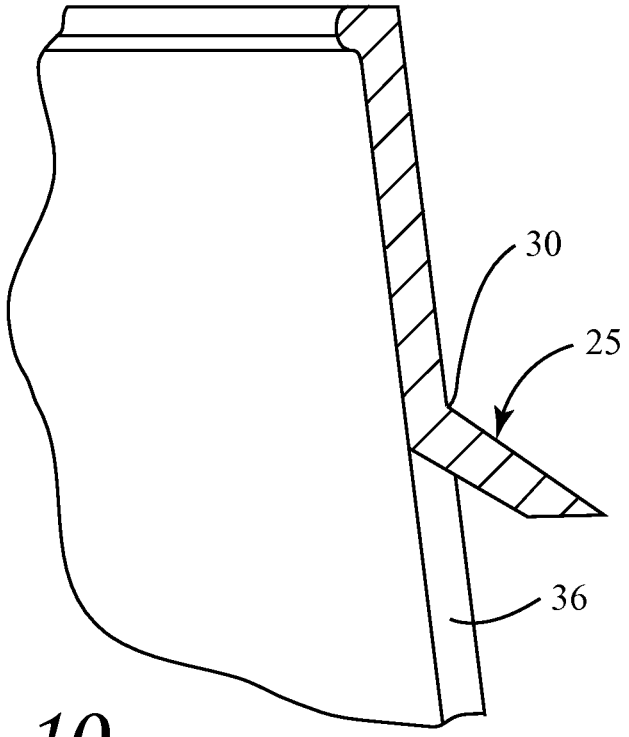
FIG. 10 is a detailed view of a portion of the locking ring labeled B in FIG. 9.

FIG. 9 shows the locking ring 18 along section A-A in FIG. 7. FIG. 10 is a detailed view of a portion of the locking ring 18, labeled B in FIG. 9. In the undeflected position shown in FIGS. 9 and 10, each tooth extends at about 50 degrees with the outer side of the body 24.

Figure 11:
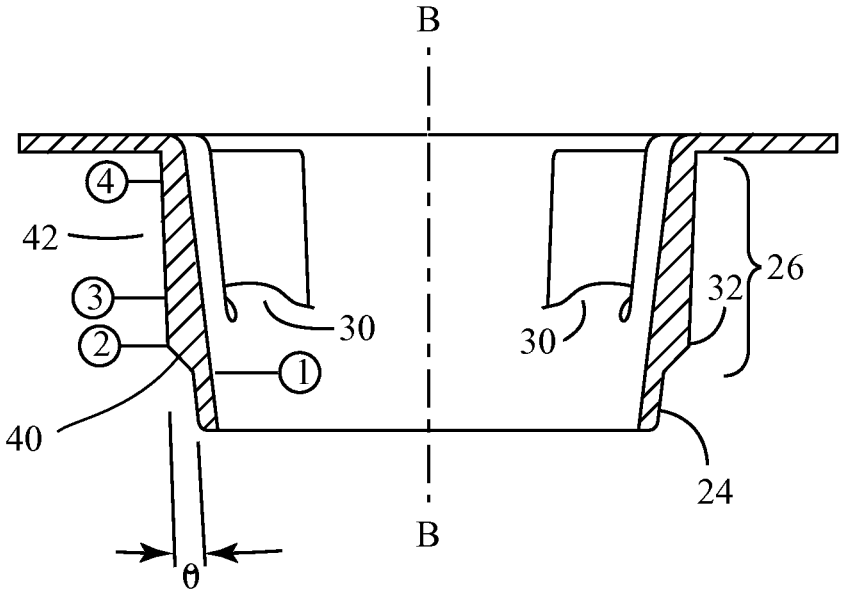
FIG. 11 is a view of the locking ring along section C-C in FIG. 7.

FIG. 11 is a view of the locking ring 18 along section C-C in FIG. 7, which passes through ribs 26 that are diametrically opposed in the embodiment shown in FIG. 7. As noted above, each rib 26 is tapered on both sides of the peak 32. Thus, each rib 26 has a first tapered portion 40 and a second tapered portion 42. The first tapered portion 40 extends at a first angle with respect to the outer side of the body 24 while the second tapered portion 42 extends at a second angle with respect to the outer side of the body 24. The second angle is less than the first angle. In one embodiment, the second angle is about 5 degrees and the first angle is about 48 degrees. In one embodiment, the second portion 42 is angled at about 92 degrees (i.e., it is generally perpendicular) with respect to the flange 22. The peak 32 is spaced longitudinally from the base 30 of each tooth 25. In one aspect, the portion of the body 24 between the first tapered portion 40 and the end 27 can be considered an alignment portion and the portion of the body 24 between the peak 32 and the flange 22 can be considered a stabilizing portion.

In use, the payout tube 12 and coil 10 are placed inside the package 14 and the locking ring 18 is located over the opening 16 in the package that aligns with an opening in the payout tube 12, as shown in FIG. 2. The locking ring 18 is positioned with the end 27 facing the payout tube 12 so that its axis B (FIG. 11) is generally in alignment with axis A of the tube (FIG. 1). The alignment portion of the body 24 is introduced first into payout tube 12 to position 1 shown in FIG. 11. Owing to the first angle of the first tapered portion 40, upon further relative longitudinal movement between the payout tube 12 and the locking ring 18 between position 1 and position 2, any misalignment between axes A and B is corrected by reorienting the body 24 of the locking ring 18 so that its axis B is parallel with the axis of the payout tube 12. Upon further insertion of the locking ring 18 between position 2 and position 3 of FIG. 11, the second portion of each rib 26 contacts the inner surface of the payout tube 12 and stabilize axis B of the locking ring 18 with respect to axis A of the payout tube 12 prior to the payout tube 12 contacting the teeth 25. Upon yet further insertion of the locking ring 18 into the payout tube 12 between positions 3 and 4 of FIG. 11, the inner surface of the payout tube 12 contacts the surfaces 39 and rounded edges 31 of teeth 25 causing the teeth 25 to resiliently deflect radially inwardly about their bases 30. Preferably, the locking ring 18 is advanced into the payout tube 12 between positions 3 and 4 so that the flange 22 contacts the rim of the packaging 14 surrounding the hole 16. Between position 3 and 4 of FIG. 11, longitudinal movement between the locking ring 18 and tube 12 will be facilitated by rotating the ring 18 in the direction of the arrow shown in FIG. 8. Such rotation allows for tightening of the flange 22 against the package 14 and the payout tube 12. Such rotation can also be used to loosen the flange 22 or to separate the ring 18 from the tube 12. However, once the ring 18 is at position 4, the barbed edges 33 of each tooth and the curved edge 31 inhibit rotation of the ring 18 in a direction opposite the arrow shown in FIG. 8 and also inhibit separating the ring 18 from tube 12 merely by pulling the ring 18 axially without rotating the ring 18. The resilience of the teeth 25 ensures that they apply pressure across edge 31 against the inner surface of the payout tube 12 sufficient to secure the locking ring 18 to the payout tube 12 when cable is drawn through the payout tube 12 and the locking ring 18 during use.

In one embodiment the locking ring 18 is formed as a unitary structure. The locking ring may be made of at least one of a plastic or a metal. For example, in one embodiment, the locking ring 18 is formed uniformly of high impact polystyrene.

In another aspect a method for packaging a wound coil of filamentary material for dispensing is provided. The payout tube 12 is disposed in the wound coil 10 of filamentary material and a first end of the filamentary material is introduced into the payout tube 12, as shown, for example, in FIG. 1. When the payout tube 12 and coil 10 are disposed in the container 14 (i.e. box 14) the first end of the filamentary material is pulled through a first hole 16 defined in a side wall of the box, as shown for example, in FIG. 2. Also, as shown in FIG. 2, the ring 18 is inserted around the first end of the filamentary material and into the hole 16 of the container 14 and into the payout tube 12. Each tooth 25 of the ring 18 is constructed to resiliently deflect radially inwardly in response to interference between the outer surface 39 of the tooth 25 and an inner wall 12*a* of the payout tube 12. More particularly, each tooth 25 deflects radially inwardly in response to interference between the surface 39 and curved edge 31 of the tooth 25 with the inner wall 12*a* of the payout tube 12. As the ring 18 is inserted into the tube 12, the interference between ribs 26 of the ring 18 and the inner wall 12*a* of the tube 12 aligns ring axis B-B with tube axis A-A. Also, interference between the outer surface of the teeth 25 and the inner wall 12*a* of the payout tube 12 secures the ring 18 to the payout tube 12. In one embodiment, the ring 18 can be rotated or threaded with respect to the payout tube 12 to effect relative axial translation of the ring 18 into the payout tube 12.

There have been described and illustrated herein several embodiments of a locking ring and a method of coupling a locking ring to a payout tube of a package of a coiled filamentary material. While particular embodiments of the invention have been described, it is not intended that the invention be limited thereto, as it is intended that the invention be as broad in scope as the art will allow and that the specification be read likewise. Thus, while a particular embodiment of a locking ring has been disclosed, it will be appreciated that other locking rings are possible as well. In addition, while particular arrangement of locking ring teeth have been disclosed, it will be understood other tooth arrangements can be used. It will therefore be appreciated by those skilled in the art that yet other modifications could be made to the provided invention without deviating from its spirit and scope as claimed.

What is claimed is:

1. A locking ring for permitting removal of wound filamentary material from a coil of filamentary material housed in a walled container through a payout tube defining a longitudinal tube axis and through which a first end of the filamentary material extends, said locking ring comprising:

an annular flange centered about a longitudinal ring axis;

a body having a tubular wall extending from an inner edge of said annular flange to a distal edge of said locking ring, said tubular wall being coaxial with said ring axis, said tubular wall having a plurality of teeth circumferentially spaced around said tubular wall and extending from said tubular wall radially outwardly and longitudinally toward said annular flange, said teeth having curved edges that are curved about said ring axis and about an axis perpendicular to said ring axis, said body constructed for relative axial and rotational movement within and with respects to the payout tube, and each tooth being constructed to resiliently deflect radially inwardly in response to interference between a curved outer surface of said tooth and an inner wall of the payout tube, said curved outer surface being curved about said ring axis, wherein an outer side of said tubular wall is frustoconical, said outer side of said tubular wall having a smaller diameter at said distal edge than at said inner edge of said annular flange.

2. The locking ring according to claim 1, wherein:

said curved edges of said teeth permit said locking ring to advance axially into and secure with the payout tube when said teeth are engaged with the inner wall of the payout tube and are rotated in a first direction with respect to the payout tube.

3. The locking ring according to claim 2, wherein:

each tooth has a barbed corner at a respective end of the curved edge that inhibits relative rotation between said teeth and the payout tube when said teeth are engaged with the inner wall of the payout tube and are rotated with respect to the payout tube in a second direction opposite the first direction.

4. The locking ring according to claim 1, wherein:

said teeth are equally spaced circumferentially.

5. The locking ring according to claim 1, wherein:

said body has a plurality of circumferentially spaced ribs, each rib extending longitudinally along said outer side of said tubular wall of said body, wherein each rib is circumferentially spaced between two of said teeth.

6. The locking ring according to claim 5, wherein:

said ribs are equally spaced circumferentially.

7. The locking ring according to claim 5, wherein:

each rib is defined by a peak and a first tapered portion extending from the peak towards said distal edge and a second tapered portion extending from the peak towards said flange.

8. The locking ring according to claim 7, wherein:

said first tapered portion is angled at a first angle with respect to said outer side of said tubular wall of said body and said second tapered portion is angled at a second angle with respect to said outer side of said tubular wall of said body, wherein said first angle is larger than said second angle.

9. The locking ring according to claim 8, wherein:

said first tapered portion is spaced axially from said distal edge of said body.

10. The locking ring according to claim 9, wherein:

said first tapered portion of each rib is constructed to align said ring axis of said locking ring with said payout tube axis of the payout tube when said distal edge of said body is introduced into the payout tube and the payout tube contacts at least one first tapered portion.

11. An assembly, comprising:

a) a wound coil of filamentary material having a first end;

b) a payout tube extending from an inside of said wound coil to an outside of said wound coil along a longitudinal tube axis, said first end of said filamentary material extending through said payout tube;

c) a box containing said wound coil and payout tube, said box having a side wall defining a first hole;

d) a ring structure having an annular flange centered about a second longitudinal ring axis and having a body having a tubular wall extending from an inner edge of said annular flange to a distal edge of said locking ring, said tubular wall being coaxial with said ring axis, and said body extending through said first hole of said box and received in said payout tube, said body further constructed for relative axial and rotational movement within and with respect to the payout tube; said tubular wall having a plurality of teeth circumferentially spaced around said tubular wall, each tooth extending radially outwardly and longitudinally toward said annular flange, and each tooth having a curved outer edge curved about the ring axis and about an axis perpendicular to the ring axis, and each tooth being resiliently deflected radially inwardly by interference between an outer curved surface of said tooth and an inner wall of said payout tube, said outer curved surface being curved about said ring axis, wherein an outer side of said wall is frustoconical, said outer side of said wall having a smaller diameter at said distal edge than at said inner edge of said annular flange.

12. The locking ring according to claim 11, wherein:

each curved outer edge of each tooth threads with said payout tube in a first rotational direction to secure said side wall of said box between said annular flange and said payout tube, and wherein each tooth has a barbed corner that inhibits relative rotation between said ring and said payout tube in a second rotational direction opposite the first rotational direction.

13. The locking ring according to claim 11, wherein:

each tooth has a barbed corner at a respective end of the tooth that digs into said inner wall of said payout tube when each tooth is engaged with said inner wall of said payout tube.

14. The locking ring according to claim 11, wherein:

said teeth are equally spaced circumferentially.

15. The locking ring according to claim 11, wherein:

said side wall of said box defines a second hole and said first end of said material extends through said body and said annular flange and is disposed in said second hole of said box.

16. The locking ring according to claim 11, wherein:

said body has a plurality of circumferentially spaced ribs, each rib extending longitudinally along said outer side of said wall of said body, wherein each rib is circumferentially spaced between two of said teeth.

17. The locking ring according to claim 16, wherein:

said ribs are in contact with said inner wall of said payout tube.

18. A method of using a locking ring for packaging a wound coil of filamentary material for dispensing, comprising:

a) disposing a payout tube in said wound coil of filamentary material and introducing a first end of said filamentary material in said payout tube, said payout tube extending along a longitudinal tube axis;

b) inserting said wound coil of filamentary material with said payout tube into a box;

c) pulling said first end of said filamentary material through a first hole defined in a side wall of the box;

d) providing a locking ring comprising:

an annular flange centered about a longitudinal ring axis;

a body having a tubular wall extending from an inner edge of said annular flange to a distal edge of said locking ring, said tubular wall being coaxial with said ring axis, said tubular wall having a plurality of teeth circumferentially spaced around said tubular wall and extending from said tubular wall radially outwardly and longitudinally toward said annular flange, said teeth having curved edges that are curved about said ring axis and about an axis perpendicular to said ring axis, said body constructed for relative axial and rotational movement within and with respects to the payout tube, and each tooth being constructed to resiliently deflect radially inwardly in response to interference between a curved outer surface of said tooth and an inner wall of the payout tube, said curved outer surface being curved about said ring axis, wherein an outer side of said tubular wall is frustoconical, said outer side of said tubular wall having a smaller diameter at said distal edge than at said inner edge of said annular flange; and e) inserting said locking ring around said first end of said filamentary material and into said hole of said box and into engagement with said payout tube.

19. A method according to claim 18, wherein:

each tooth has a curved edge that extends circumferentially from a leading corner to a trailing barbed corner, and wherein said inserting comprises rotating said locking ring, leading corner-first, to thread said curved edges of said teeth with said inner wall of said payout tube to axially advance said locking ring into said payout tube and secure said locking ring to said payout tube.

* * * * *